US005409793A

United States Patent [19]

Sacripante et al.

[11] Patent Number: 5,409,793

[45] Date of Patent: Apr. 25, 1995

[54] POLYIMIDE-IMINE TONER AND DEVELOPER COMPOSITIONS

[75] Inventors: Guerino G. Sacripante, Oakville; B. W. Anissa Yeung, Mississauga; Melvin D. Croucher, St. Catherines, all of Canada; J. Stephen Kittelberger, Rochester, N.Y.

[73] Assignee: Xerox Corporation, Stamford, Conn.

[21] Appl. No.: 221,596

[22] Filed: Apr. 1, 1994

[51] Int. Cl.[6] ..... G03G 9/087

[52] U.S. Cl. ..... 430/106.6; 435/109; 435/126; 435/904

[58] Field of Search ..... 430/109, 904, 106.6, 430/126

[56] References Cited

U.S. PATENT DOCUMENTS

| | | | |
|---|---|---|---|
| 4,513,094 | 4/1985 | Nash et al. | 430/106.6 |
| 4,543,313 | 9/1985 | Mahabadi et al. | 430/109 |
| 4,560,635 | 12/1985 | Hoffend et al. | 430/106.6 |
| 5,032,484 | 7/1991 | DeMejo et al. | 430/109 |
| 5,238,768 | 8/1993 | Ong | 430/110 |
| 5,348,830 | 9/1994 | Sacripante et al. | 430/109 |
| 5,348,831 | 9/1994 | Sacripante et al. | 430/109 |

OTHER PUBLICATIONS

Encyclopedia of Polymer Science and Engineering, vol. 12, 2nd Edition, published by Wiley (1985) pp. 364–383.

*Primary Examiner*—Christopher D. Rodee
*Attorney, Agent, or Firm*—E. O. Palazzo

[57] ABSTRACT

A toner comprised of pigment, and a polyimide-imine resin of the formula

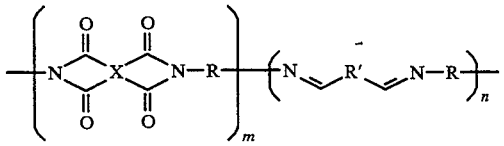

wherein m, and n represent the number of monomer segments; X is independently selected from the group consisting of a tetravalent aromatic, polyarylomatic or cycloaliphatic group with from about 6 to about 20 carbon atoms and a cycloaliphatic group; R is independently selected from the group consisting of alkylene, oxyalkylene and polyoxyalkylene; and R′ is independently selected from the group consisting of alkyl, alkylene and arylene.

22 Claims, No Drawings

POLYIMIDE-IMINE TONER AND DEVELOPER COMPOSITIONS

BACKGROUND OF THE INVENTION

This invention is generally directed to toner and developer compositions, and more specifically, the present invention is directed to developer and toner compositions containing novel polyimide-imine resins, and process for the preparation thereof. In embodiments, there are provided in accordance with the present invention, toner compositions comprised of polyimide-imine resins, and pigment particles comprised of, for example, carbon black, magnetites, or mixtures thereof, cyan, magenta, yellow, blue, green, red, or brown components, or mixtures thereof, thereby providing for the development and generation of black and/or colored images. In embodiments, there are provided in accordance with the present invention toners with a polyimide-imine resin of the following formula, and which resins are preferably obtained by melt condensation processes

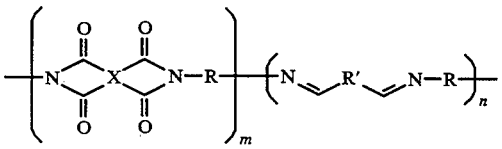

X =

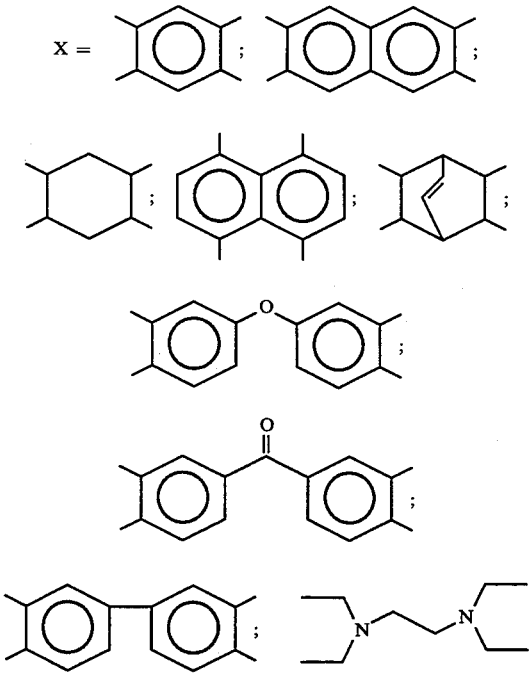

X can generally be aryl, diaryl, or cycloaliphatic, and is attached or bonded to the four imide carbonyl moieties; and more specifically X is a tetravalent aromatic or diaromatic radical or group wherein m and n represent the number of random monomer segments, m is preferably from about 100 to about 10,000 and n is preferably from about 10 to about 1,000; R is alkyl, oxyalkylene, or polyoxyalkylene such as as an alkylene oxide like diethylene oxide, triethyleneoxide or polyoxypropylene; and R' is an alkylene with, for example, from about 1 to about 23 carbons, an aryl like phenyl or alkyl. The toner compositions of the present invention in embodiments possess a number of advantages including deinkabilility, that is for example the ease with which toner is removed from paper and subsequently separated from the pulp during the recycling process as practiced by the paper and pulping industries, low melting characteristics, excellent blocking characteristics, possess excellent admix characteristics, and low relative humidity sensitivity such as from about 1.01 to about 2.3. Aryl can include components with from 6 to about 30 carbon atoms such as phenyl, naphthyl, benzyl and the like. Alkylene includes components with from 2 to about 25 carbon atoms such as ethylene, propylene, butylene, pentylene, and the like. Alkyl includes components with 1 to about 25 carbon atoms; and aliphatic includes alkyl.

The toner composition of the present invention can in embodiments be generated by a preparative process involving the melt polycondensation of about 0.85 mole equivalent of dianhydride, such as pyromellitic dianhydride, from about 0.15 mole equivalent of a dialdehyde, such as terephthaldicarboxaldehyde, and of from about 1 mole equivalent of an alkylene diamine, or preferably a diamino terminated alkylene oxide, such as the diamino terminated polyalkylene oxide available from Texaco Chemicals as JEFFAMINE D-230 TM, D-400 TM, D-700 TM, EDR-148 TM, EDR-192 TM as illustrated by the formula

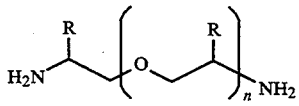

wherein

| | |
|---|---|
| EDR-148 | n = 2; R = H |
| EDR-192 | n = 3; R = H |
| D-230 | n = 2, 3; R = $CH_3$ |
| D-400 | n = 5, 6; R = $CH_3$. |

The aforementioned resins exhibit a number average molecular weight of from about 1,500 to about 50,000 grams per mole as measured by vapor phase osmometry, and a ! ]lass transition temperature of from about 40° C. to about 80° C., and more preferably of from about 50° C. to about 65° C. as measured by the Differential Scanning Calorimeter. In another embodiment, the polyimide-imine can be generated by a preparative process involving the reaction of about 0.7 mole equivalent to about 1 mole equivalent of a symmetrical mesogenic dianhydride, such as pyromellitic dianhydride, and of from about 0.7 to about 1 mole equivalent of an alkylene diamine, or preferably diamino terminated alkylene oxides such as the diamino terminated polypropylene oxide or diamino terminated polyethylene oxide available from Texaco Chemical as JEFFAMINE TM, and a dialdehyde, such as terephthaldehyde or 1,4-butyldialdehyde, selected in an amount of from about 0.1 mole equivalent to about 0.3 mole equivalent, and which is believed to impart good deinkability to the resulting toner by formation of the imine moieties in the polyimide-imine resin, and which polyimide-imine resin with a number average molecular weight of from about 1,500 to about 50,000 grams per mole as measured by vapor phase osmometry, and a glass transition temperature of from about 40° C. to about 70° C., and more preferably of from about 50° C. to about 64° C. as measured by the Differential Scanning Calorimeter.

Examples of advantages of the toner composition of the present invention comprised of polyimide-imine include deinkability from paper during recycling. Paper recycling has become an important environmental issue in recent years, and deinking of conventional dry toner images can be a much more difficult problem for the paper recycling industry than that of conventional impact printing inks. The recycling industry utilizes various processes, but the first step is usually to repulp the waste paper in an agitated caustic bath. More specifically, the process involves shredding the paper in an agitated aqueous slurry of about 10 percent consistency by weight of paper at a pH of about 11. The aforementioned pH is attained by the addition of caustic soda or sodium bicarbonate. The aqueous slurry is then heated at 145° C. for a duration of from about 45 minutes to about 60 minutes. During this repulping stage, the paper absorbs large amounts of water, swells considerably, and is reduced to a slurry of individual hydrated pulp fibers. During this process, various inks are detached from the fibers by differential swelling or disintegration. Dry toner images do not usually swell because of their hydrophobic polymeric composition, and they are not usually degraded by chemical hydrolysis. Dry toner images result in flat platelets about 100 to 200 microns in average diameter and about 10 microns in thickness as measured by microscopic image analysis methods. Conventional impact printing inks a re found to disintegrate into much smaller particles, typically 10 microns or less in diameter, primarily because they contain no fused thermoplastic binder resins.

Subsequent steps in the deinking process are designed to remove the liberated ink specks from the hydrated pulp slurry. With small specks liberated from impact-printed papers, these steps are simple and efficient. One or two washing cycles are often sufficient to rinse the small liberated ink specks from the slurry to adequate cleanliness. If this is insufficient, a flotation cell can be added to further clean the pulp. In case the waste paper is imaged with dry toner, the slurry contains the much larger aforementioned toner platelets. To achieve adequate cleaning of such pulps the recycling industry has found it necessary to employ a much more elaborate process. Typically, this comprises six flotation cells in series. Subsequently, the pulp is dewatered in preparation for a high-shear dispersion step to further break up the remaining specks. The dispersion step is energy intensive, and is accompanied by a certain amount of fiber damage. Following this and a redilution step, up to another four flotation steps may be required to remove the broken specks to an adequate cleanliness.

In the present invention, the toner compositions are comprised of a polyimide-imine resin. Under the caustic repulping conditions of a pH of about 11, the imine functionality hydrolyzes and decomposes to oligomeric polyimide residues. This causes the toner particles to break up to less than or equal to about 25 microns, and preferably from about 15 microns to about 25 microns in average volume diameter. This enables the use of the aforementioned simple ink speck removal process typically effective only for impact-printed papers. Therefore, the toner ink specks are much easier to remove, resulting in a more economical process and better quality pulp.

Other advantages associated with toner compositions of this invention in embodiments include low fusing temperatures, such as from about 120° C. to about 140° C., and thus lower fusing energies are required for fixing thereby enabling less power consumption during fusing, and permitting extended lifetimes for the fuser system selected. Furthermore, the toner composition of this invention possesses a broad fusing latitude, such as from about 40° C. to about 100° C., with minimal use of release oil or avoidance of release oil, which inhibits the toner from offsetting onto the fuser rollers usually associated with ghosting or background images on subsequent copies. Furthermore, the fused image obtained from the toner compositions of the present invention in embodiments does not substantially offset to vinyl covers, such as those utilized for notebook binders, and possess low humidity sensitivity ratio of from about 1 to about 2.3 as calculated by the ratio of the triboelectric charge (in microcoulombs per gram) of the developer after placed in a chamber of 20 percent humidity for 48 hours, to the triboelectric charge (in microcoulombs per gram) of the developer after placed in a chamber of 80 percent humidity for 48 hours.

In designing resins for toner composition, it is generally desired that the glass transition temperature of the resin be from about 50° C. to about 65° C., and preferably no less than about 55° C. so that, for example, the toner particles do not aggregate, coalesce or block during manufacturing, transport or storage or until the toner is required for the fixing step. Additionally, low fusing characteristics are required, hence the resin should melt or flow as low in temperature as possible such as from about 120° C. to about 145° C. Moreover, low relative humidity sensitivity of toners are desired such that the triboelectric charge is stable to changes in environmental humidity conditions.

Thermotropic liquid crystalline polyimide resins are illustrated in U.S. Pat. No. 5,348,930, the disclosure of which is totally incorporated herein by reference, which illustrates toner and developer compositions with thermotropic liquid crystalline polyesters, polyamides, and polycarbonates. The toner composition of this invention differs in that, for example, the polyimide structure does not contain the moieties illustrated, which are believed necessary to impart deinkability characteristics. The aforementioned deinkability characteristics of the toners of this invention are attained by the ease in effecting hydrolysis of the imine functionality in caustic conditions, such as from about pH of 10 to about a pH of 14, and resulting in the degradability of resin, hence deinkability of toner from paper fiber and/or pulp.

There is disclosed in copending application U.S. Ser. No. 144,075 toner compositions comprised of a crosslinked polyimide resin and pigment, and process thereof. There is also disclosed in copending application U.S. Ser. No. 144,918 gloss switching toners with certain polyimides. The toner compositions of the copending application U.S. Ser. No. 144,075 are crosslinked to about 30 gel or more and are believed to yield with broad fusing latitude characteristics, and moreover result in low gloss characteristics and not high gloss. The toner composition of this invention are not crosslinked and also contain imine moieties necessary for good deinkability.

Polyimide resins, liquid crystalline polyimide resins and more specifically polyimide resins are also known, such as summarized and illustrated in the *Encyclopedia of Polymer Science and Engineering,* 2nd Edition, Volume No. 12, published by Wiley (1985). However, these polyimide resins are wholly aromatic and useful as high performance materials, and no mention for use as toners are described in this reference. Specifically that polyimide-imine resins with flexible diamino alkane moieties and, more specifically, polyoxyalkylene moieties are not mentioned, and we believe to be novel class as illustrated herein this invention.

Illustrated in the following copending applications, the disclosures of each being totally incorporated herein by reference, are:

U.S. Ser. No. 144,075 illustrates a toner composition comprised of a pigment and a crosslinked polyimide; and wherein the crosslinked polyimide can be obtained from the reaction of a peroxide with an unsaturated polyimide of the formula

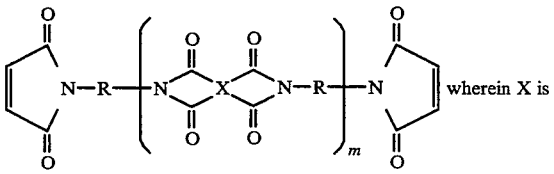

wherein X is

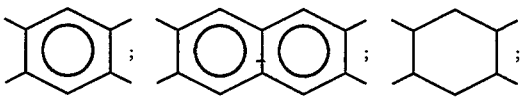

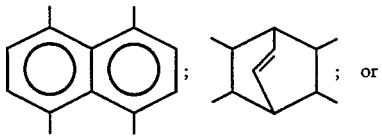

or

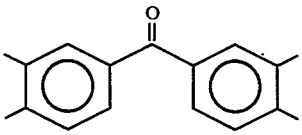

R is alkyl, polyoxyalkyl or oxyalkylene; and m represents the number of monomer segments present and is, for example, a number of from about 10 to about about 1,000.

U.S. Pat. No. 5,348,831 illustrates a toner composition comprised of pigment, and a polyester imide resin of the formula

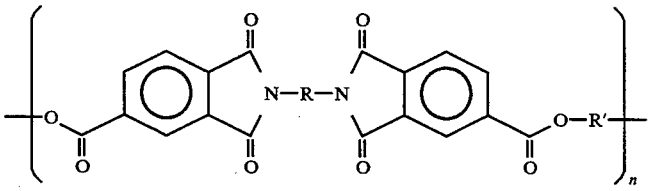

wherein n represent the number of segments present and is a number of from about 10 to about 10,000; R' is alkyl or alkylene; and R is independently selected from the group consisting of an oxyalkylene and polyoxyalkylene.

U.S. Ser. No. 144,918 illustrates a toner composition comprised of pigment, and polyimide of the formula

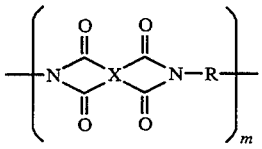

wherein m represents the number of monomer segments present; X is

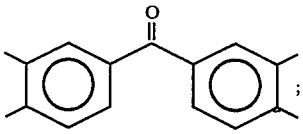

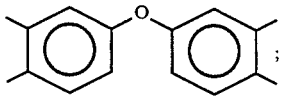

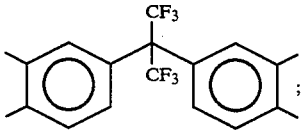

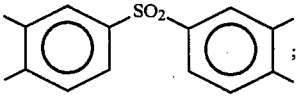

or

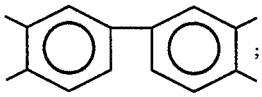

thus X can be benzophenone, oxydiphthalic, hexafluoropropane diphenyl, diphenyl sulfone, or biphenyl; and X is attached to four imide carbonyl moieties; and R is independently selected from the group consisting of alkyl, oxyalkylene and polyoxyalkylene.

Specifically, in embodiments, the present invention relates to a toner composition comprised of a pigment, charge control agent and polyimide-imine resins as illustrated herein, and which toners possess deinkability wherein the toner resin decomposes in alkaline or caustic aqueous conditions such as at a pH of from about 10 to a pH of about 14, low fixing of from about 120° C. to about 140° C., high gloss such as from about 50 gloss units to about 80 gloss units as measured by the Garner Gloss metering unit, nonvinyl offset properties and in addition low relative humidity sensitivity such as from about 1.0 to about 2.0 as calculated by Equation 1. These and other advantageous are attained by the toner compositions of this invention comprised of a pigment, optionally a charge control agent and, moreover, a polyimide resin derived from a mesogenic dianhydride and organodiamine, which exhibits low fixing of from about 120° C. to about 140° C., high gloss such as from about 50 gloss units to about 80 gloss units, nonvinyl offset properties and low relative sensitivity such as from about 1.0 to about 2.3.

SUMMARY OF THE INVENTION

It is an object of tile present invention to provide toner and developer compositions with many of the advantages illustrated herein.

In another object of the present invention there are provided toner compositions with polyimide-imine, and which toners are useful for the development of electrostatic latent images including color images.

In yet another object of the present invention there are provided processes for the preparation of polyimide-imine.

Moreover, in another object of the present invention that are provided toner compositions comprised of polyimide-imine with excellent deinkability such that the fused toner resin decomposes in alkaline or caustic aqueous conditions such as at a pH of from about 10 to a pH of about 14.

Moreover, in another object of the present invention that are provided toner compositions comprised of polyimide-imine with low melt fusing temperatures of from about 130° C. to about 145° C.

Moreover, in another object of the present invention that are provided toner compositions comprised of polyimide-imine with low melt fusing temperatures of from about 130° C. to about 145° C. and broad fusing latitude of from about 30° C. to about 60° C.

In another object of the present invention that are provided toner compositions comprised of polyimide-imine with glass transition temperatures of from about 50° C. to about 65° C.

In yet another object of the present invention that are provided toner compositions comprised of polyimide-imine resin with number average molecular weights of from about 1,500 grams per mole to about 100,000 grams per mole as measured by GPC.

In yet another object of the present invention there are provided developer compositions comprised of a toner which displays high projection efficiency on transparency such as from about 60 to about 99 percent projection using a Match Scan II spectrophotometer available from Diana.

Additionally, it is an object of the present invention to provide a toner which displays high gloss such as from about 30 to about 60 gloss units as measured by the Gardner Gloss metering unit.

Moreover, it is an object of the present invention to provide a toner which displays low relative sensitivity such as from about 1.0 to about 2.3 as measured from the triboelectric charge ratio at 20 percent humidity level to 80 percent humidity.

Another object of the present invention resides in the formation of toners which will enable the development of images in electrophotographic imaging apparatuses, which images have substantially no background deposits thereon, are substantially smudge proof or smudge resistant, and therefore are of excellent resolution; and further, such toner compositions can be selected for high speed electrophotographic apparatuses, that is those exceeding 70 copies per minute.

Also, in another object of the present invention there are provided developer compositions comprised of toner and carrier particles.

Further, another object of the present invention resides in the provision of environmentally deinkable toners containing polyimide-imine resins.

These and other objects of the present invention can be accomplished in embodiment thereof by providing toner compositions comprised of polyimide-imine of the formulas as illustrated herein, and pigment particles.

The polyimide-imine resins of the present invention can be prepared as illustrated herein, and, more specifically, in embodiments by charging a reactor, equipped with a bottom drain valve, double turbine agitator and distillation receiver with a cold water condenser with from about 0.85 to about 0.99 mole of a dianhydride monomer such as pyromellitic dianhydride, 0.01 to about 0.15 mole of dialdehyde such as terephthaldicarboxaldehyde, and 0.95 to about 1.05 mole of flexible diamine such as diamino terminated polyoxypropylene available as JEFFAMINE 230 TM from Texaco Chemicals. The reactor is then heated to from about 150° C. to about 170° C. with stirring for a duration of from about 3 hours whereby 0.5 to about 0.9 mole of water byproduct is collected in the distillation receiver. The mixture is then heated from about 180° C. to about 210° C., after which the pressure is slowly reduced from atmospheric pressure to about 300 Torr over a period of from about one hour to about 5 hour period with collection of approximately 0.1 to about 0.3 mole of water in the distillation receiver, and wherein the total amount of water collected from the beginning of the reaction is from about 0.95 to about 1.0 mole equivalent. The reactor is then purged with nitrogen to atmospheric pressure, and the resulting polyimide-imine collected through the bottom drain valve. The glass transition temperature of the resin can then be measured to be of from about 45° C. to about 65° C. (onset) utilizing the 910 Differential Scanning Calorimeter available from DuPont operating at a heating rate of 10° C. per minute. The number average molecular weight can be measured to be of from about 1,500 grams per mole to about 100,000 gram per mole by vapor phase calorimetry.

Specific examples of polyimide-imine resins of the present invention include poly(N-ethytoxyethyloxyethyl-1,2,4,5-pyromellitimido-N-ethyloxyethyloxyethyl-1-iminomethylphenyl-3-methylimine), poly(N-ethyloxyethyloxyethyloxyethyl-1,2,4,5-pyromellitimido-N-ethyloxyethyloxyethyloxyethyl-1-iminomethylphenyl-3-methylimine), poly(N-propyloxypropyloxypropyloxypropyl-1,2,4,5-pyromellitimido-N-propyloxypropyloxypropyloxypropyl-1-iminomethylphenyl-3-methylimine), poly(N-propyloxypropyloxypropyloxypropyloxypropyloxypropyl-1,2,4,5-pyromellitimido-N-piropyloxypropyloxypropyloxypropyl oxypropyloxypropyl-1-iminomethylphenyl-3-methylimine), which resin is present in various effective amounts in the toner, such as from about 85 percent by weight to about 98 percent by weight of the toner, comprised of, for example, resin and pigment.

Specific examples; of dianhydride or tetracid monomers that can be utilized to prepare the polyimide-imine resins include pyromellitic dianhydride, pyromellitic tetracarboxylic acid, bicyclo[2.2.2]oct-7-ene2,3,5,6-tetracarboxylic acid, bicyclo[2.2.2]oct-7-ene-2,3,5,6-tetracarboxylic dianhydride, 1,2,4,5-cyclohexanetetracarboxylic acid, 1,2,4,5-cyclohexanetetracarboxylic dianhydride, 1,4,5,8-naphthalenetetracarboxylic dianhydride, 3,4,9, 10-perylenetetracarboxylic dianhydride, ethylenediamine terracetic acid dianhydride, mixtures thereof, and the like selected in an effective amount of, for example, from about 0.45 to about 0.55 mole equivalent of polyimide-imine.

Specific examples of dialdehyde that can be utilized to prepare the polyimide-imine toner resins include terephthaldicarboxaldehyde, isophthalaldehyde, phthalic dicarboxaldehyde, 1,3-glutaric dialdehyde, 1,4-adipic dialdehyde, pimelic dialdehyde, suberic dialdehyde, azealic dialdehyde, sebacic dialdehyde, nonaic dialdehyde, decanoic dialdehyde, dodecanoic dialdehyde, tridecanoic dialdehyde, mixtures thereof, and the like selected in an effective amount of, for example, from about 0.01 to about 0.15 mole equivalent of polyimide-imine.

Specific examples of diamino alkanes or diamino alkylene oxide that can be utilized to prepare the polyimide-imine include diaminoethane, diaminopropane, 2,3-diaminopropane, diaminobutane, diaminopentane, diamino-2-methylpentane also known as DYTEKA TM available from E. I. DuPont Chemical Company, diaminohexane, diamino-trimethylhexane, diaminoheptane, diaminooctane, diaminononane, diaminodecane, diaminododecane, diaminoterminated-ethylene oxide, diaminoterminated-diethylene oxide available as JEFFAMINE EDR-148 TM from Texaco Chemicals, diaminoterminated-diethylene oxide available as JEFFAMINE EDR-148 TM from Texaco Chemicals, diaminoterminated-triethylene oxide available as JEFFAMINE EDR-192 TM from Texaco Chemicals, diaminoterminated-polyoxypropylene oxide available as JEFFAMINE D-230 TM, JEFFAMINE 400 TM, JEFFAMINE 700 TM all available from Texaco Chemicals, mixtures thereof, and thee like; and is selected in an effective amount of, for example, from about 0.45 mole equivalent to about 0.55 mole equivalent of polyimide-imine resin.

Various known colorants present in the toner in an effective amount of, for example, from about 1 to about 25 percent by weight of toner, and preferably in an amount of from about 1 to about 15 weight percent that can be selected include carbon black like REGAL 330® magnetites, such as Mobay magnetites MO8029 TM, MO8060 TM; Columbian magnetites; MAPICO BLACKS TM and surface treated magnetites; Pfizer magnetites CB4799 TM, CB5300 TM, CB5600 TM, MCX6369 TM; Bayer magnetites BAYFERROX 8600 TM, 8610 TM; Northern Pigments magnetites NP-604 TM, NP-608 TM; Magnox magnetites TMB-100 TM, or TMB-104 TM; and other equivalent black pigments. As colored pigments there can be selected known cyan, magenta, yellow, red, green, brown, blue or mixtures thereof. Specific examples of pigments include HELIOGEN BLUE L6900 TM, D6840 TM, D7080 TM, D7020 TM, PYLAM OIL BLUE TM and PYLAM OIL YELLOW TM, PIGMENT BLUE 1 TM available from Paul Uhlich & Company, Inc., PIGMENT VIOLET 1 TM, PIGMENT RED 48 TM, LEMON CHROME YELLOW DCC 1026 TM, E.D. TOLUIDINE RED TM and BON RED C TM available from Dominion Color Corporation, Ltd., Toronto, Ontario, NOVAperm YELLOW FGL TM, HOSTAPERM PINK E TM from Hoechst, and CINQUASIA MAGENTA TM available from E. I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK TM, and cyan components may also be used as pigments. The pigments arc selected in various effective amounts of, for example, from about 1 weight percent to about 65 weight percent of the toner.

The toner may also include in effective amounts, such as from about 0.1to about 10 weight percent, known charge additives such as alkyl pyridinium halides, bisulfates, the charge control additives of U.S. Pat. Nos. 3,944,493; 4,007,293; 4,079,014; 4,394,430, and 4,560,635, which illustrates a toner with a distearyl dimethyl ammonium methyl sulfate charge additive, the disclosures of which are totally incorporated herein by reference, and the like.

Surface additives in effective amounts, such as from about 0.1 to about 3 weight percent, that can be added to the toner compositions of the present invention include, for example, metal salts, metal salts of fatty acids, colloidal silicas, mixtures thereof and the like, reference U.S. Pat. Nos. 3,590,000; 3,720,617; 3,655,374 and 3,983,045, the disclosures of which are totally incorporated herein by reference. Preferred additives include zinc stearate and AEROSIL R972® available from DeGussa.

In another embodiment of the present invention there are provided, subsequent to known micronization and classification, toner particles with an average volume diameter as determined by a Coulter Counter of from about 5 to about 20 microns comprised of a polyimide resin, and pigment particles, and optional charge enhancing additives.

The polyimide-imine resin is usually present in the toner a sufficient, but effective amount, for example from about 70 to about 95 weight percent. Thus, when 1 percent by weight of a charge enhancing additive is present, and about 7 percent by weight of pigment or colorant, such as carbon black, is contained in the toner, about 92 percent by weight of resin is selected. Also, the charge enhancing additive may be coated on the pigment particles.

The toner and developer compositions of the present invention may be selected for use in electrostatographic imaging apparatuses containing therein conventional photoreceptors providing that they are capable of being charged negatively. Thus, the toner and developer compositions of the present invention can be used with layered photoreceptors that are capable of being charged negatively, such as those described in U.S. Pat.

No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys. Other similar photoreceptors can be selected providing the objectives of the present invention are achievable The following Examples are being supplied to further define various species of the present invention, it being noted that these Examples are intended to illustrate and not limit the scope of the present invention. Parts and percentages are by weight unless otherwise indicated.

EXAMPLE I

A polyimide-imine derived from pyromellitic dianhydride, terephthaldicarboxaldehyde and diamino terminated polyoxypropylene with an average molecular weight of 230, available as JEFFAMINE D-230 TM from Texaco Chemical Company, was prepared as follows.

Pyromellitic dianhydride ( 171 grams), terephthaldicarboxaldehyde (5.4 grams), JEFFAMINE D-230 TM (165 grams), and JEFFAMINE D-400 TM (42.9 grams) were charged into a 300 milliliter Parr reactor equipped with a mechanical stirrer, distillation receiver and bottom valve drain. The mixture was heated to 150° C. and stirred for 30 minutes, followed by increasing the temperature to 175° C. whereby water started to distill. The mixture was then maintained at 175° C. for 2 hours whereby 10 grams of water (90 percent) were collected. The reactor was then increased to 200° C. with slow purging of nitrogen for 30 minutes and then at 225° C. for another 30 minutes. The bottom drain of the reactor was then opened, and the polyimide-imine resin was allowed to pour into a container cooled with dry ice, and measured to be 300 grams. The number average molecular weight of the polyimide-imine resin product poly(N-propyloxypropyloxypropyl-1,2,4,5-pyromellitimido-N-1-propyloxypropyloxypropylimino-methylphenyl-3-methylimine) was then measured to be 25,030 grams per mole by vapor phase osmometry using toluene as the solvent. The glass transition temperature of the resin was measured using the DuPont Differential Scanning Calorimeter at 10° C. per minute and found to be 48° C.

EXAMPLE II

A polyimine derived from pyromellitic dianhydride, terephthaldicarboxaldehyde and diamino-terminated polyoxypropylene with an average molecular weight of 400, available as JEFFAMINE D-400υ from Texaco Chemical Company, was prepared as follows:

Terephthaldicarboxaldehyde (4.0 grams) and anhydrous magnesium sulfate (15.1 grams) were dissolved in 100 milliliters of dichloromethane. To this solution, JEFFAMINE 400 TM (12.5 grams) was added. The resulting mixture was stirred at room temperature for 26 hours. The solid was filtered off and the filtrate was concentrated. A light yellow, viscous liquid was obtained. The number average molecular weight of the resin polyimide-imine poly(N-propyloxypropyloxypropyloxypropyloxypropyl-1,2,4,5-pyromellitimido-N1-propyloxypropyloxypropyloxypropyloxypropylimino-methylphenyl-3-methylimine) product was measured to be 4,982 grams per mole, and the weight average molecular weight of the resin product was measured to be 11,123 grams per mole by gel permeation chromatography.

EXAMPLE III

A polyimine derived from pyromellitic dianhydride, terephthaldicarboxaldehyde and 2-methyl-1,5-diaminopentane available as DYTEK A TM from DuPont was prepared as follows.

Terephthaldicarboxaldehyde (4.0 grams) and anhydrous magnesium sulfate (15.1 grams) were dissolved in 100 milliliters of dichloromethane. To this slurry was added 2-methyl-1,5-diaminopentane (3.8 grams). The resulting mixture was stirred at room temperature for 18 hours. The solid was filtered off and the filtrate was concentrated. A viscous liquid product poly(2-methyl-1,5-diaminopentaneterephthaldicarboxdiimine) was obtained, which has a number average molecular weight of 2,017 and weight average molecular weight of 3,347 as measured by gel permeation chromatography.

EXAMPLE IV

A polyimine derived from pyromellitic dianhydride, terephthaldicarboxaldehyde and diamino-terminated polyoxypropylene with an average molecular weight of 148, available as JEFFAMINE D-148 TM from Texaco Chemical Company, was prepared as follows.

Terephthaldicarboxaldehyde (25 grams) was placed in a three-necked flask, which was immersed in an oil bath, under argon. JEFFAMINE EDR-148 TM (28.9 grams) was added into the flask at room temperature. The temperature of the bath was increased to 130° C. and the mixture was stirred for 25 minutes. During this time, steam was coming out. The pressure of the system was lowered to 50 Torr for a few minutes. About 5 milliliters of liquid was collected. The sample was discharged from the flask to provide a white solid resin. The resulting polyimide-imine product poly(N-ethyloxyethyloxyethyl-1,2,4,5-pyromellitimido-N-ethyloxyethyloxyethyl-1-iminomethylphenyl-3-methylimine) has a Tg of −2.1° C., a Tms of 84.7° C. and 106.0° C. by scanning differential calorimetry.

EXAMPLE V

A toner composition comprised of 98 percent by weight of the polyimide-imine resin of Example I and 2 percent by weight of PV FAST BLUE TM, pigment was prepared as follows.

The polyimide-imine resin of Example I was in the form of a large chunk. The resulting polymer was ground to about 500 microns average volume diameter in a Model J Fitzmill equipped with an 850 micrometer screen. After grinding, 117.6 grams (98 percent by weight of toner) of polymer were mixed with 2.4 grams of PV FAST BLUE TM pigment (2 percent by weight of toner) available from Hoechst Chemical Corporation. The two components were dry blended first on a paint shaker and then on a roll mill. A small CSITM counterrotating twin screw extruder available from Customs Scientific Instrumentations was then used to melt mix the aforementioned mixture at a barrel temperature of 140° C., screw rotational speed of 50 rpm and at a feed rate of 2 grams per minute. The extruded strands were broken into coarse particles utilizing a coffee bean grinder available from Black and Decker. An 8 inch Sturtevant micronizer was used to reduce the particle size further. After grinding, the toner was measured to display an average volume diameter particle size of 9.1 microns with a geometric distribution of 1.39 as measured by the Coulter Counter. The resulting toner was then utilized without further classification. A developer composition was prepared by roll milling the aforementioned toner, 3 parts by weight with 100 parts by weight of 80 micron diameter carrier comprised of a steel core with polyvinylidenefluoride (KYNAR®) polymer coating thereof, 0.75 weight percent. The tribo data was obtained using the known blow-off Farad,ay Cage apparatus, and the toner developer was subjected to 20 percent humidity in a chamber for 48 hours, and at 80 percent humidity level in a chamber for 48 hours. The ratio of the corresponding triboelectric charge at 20 percent RH to 80 percent RH as given by Equation 1 was measured to be 1.9. Unfused copies were then produced using a Xerox Corporation 1075 imaging apparatus with the fusing system disabled. The unfused copies were then subsequently fused with the 1075 fuser. Fusing evaluation of the toner indicated a minimum fixing temperature of about 124° C., and a hot-offset temperature of 160° C.

EXAMPLE VI

Deinkability of the polyimide-imine fused toner images generated from Example V at a pH of 10.

The fused image of Example V, comprised of a solid square area of 6 inches in diameter and with a toner mass per area of 1.1 milligram per square centimeter, was immersed in a 4 liter beaker containing an aqueous solution of sodium bicarbonate (20 grams) with a pH of about 10. The immersed image was left undisturbed at ambient temperature for 3 hours, during which the image was completely removed from the paper. The aqueous mixture was then neutralized with dilute, 1 normal, hydrochloric acid, and the organic portion was extracted with 100 milliliters of methylene chloride. The, organic extract was then concentrated to a viscous liquid utilizing a rotary evaporator, and found to display a weight average molecular weight of 456 grams per mole by gel permeation chromatography, thus confirming the decomposition of the toner resin under basic conditions.

Other embodiments and modifications of the present invention may occur to those skilled in the art subsequent to a review of the information presented herein; these embodiments and modifications, as well as equivalents thereof, are also included within the scope of this invention.

What is claimed is:

1. A toner comprised of pigment, and a polyimide-imine resin of the formula

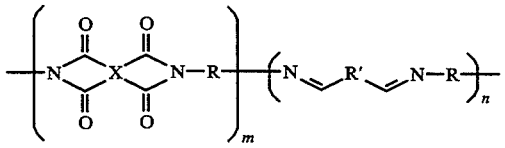

wherein m, and n represent the number of monomer segments, and wherein m is a number of from about 100 to about 10,000 and n is a number of from about 10 to about 1,000; X is independently selected from the group consisting of a tetravalent aromatic, polyaromatic or cycloaliphatic group with from about 6 to about 20 carbon atoms and a cycloaliphatic group; R is independently selected from the group consisting of alkylene, oxyalkylene and polyoxyalkylene; and R′ is independently selected from the group consisting of alkylene and arylene.

2. A toner in accordance with claim 1 wherein R is alkyl with from 1 to about 25 carbon atoms.

3. A toner in accordance with claim 1 wherein R′ is phenyl, methylene, ethylene, propylene, butylene, pentylene, hexylene, heptylene, octylene, nonylene, decylene, undecylene, dodecylene, stearylene, or mixtures thereof.

4. A toner in accordance with claim 1 wherein said tetravalent X is selected from the group consisting of benzene, naphthane, anthrane, phenanthrane, cyclohexyl, bicyclo[2.2.2]oct-7-ane, perylene, and mixtures thereof.

5. A toner in accordance with claim 1 wherein R oxyalkylene is selected from the group consisting of diethyleneoxide, dipropyleneoxide, triethyleneoxide, polypropyleneoxide, and mixtures thereof.

6. A toner in accordance with claim 1 wherein the polyimide-imine resin is selected from the group consisting of poly(N-ethyloxyethyloxyethyl-1,2,4,5-pyromellitimido-N-ethyloxyethyloxyethyl-1-iminomethylphenyl-3-methylimine), poly(N-ethyloxyethyloxyethyl 1,2,4,5-pyromellitimido-N-ethyloxyethyloxyethyloxyethyl-1-iminomethylphenyl-3-methylimine), poly(N-propyloxypropyloxypropyloxypropyl-1,2,4,5-pyromellitimido-N-propyloxypropyloxypropyloxypropyl-1-iminomethylphenyl-3-methylimine), and poly(N-propyloxypropyloxypropyloxypropyloxypropyloxypropyl-1,2,4,5-pyromellitimido-N-propyloxypropyloxypropyloxypropyloxypropyloxypropyl-1-iminomethylphenyl-3-methylimine).

7. A toner in accordance with claim 1 wherein the polyimide-imine has a $M_n$ of from about 1,500 to about 20,000, and an $M_w$ of from about 2,500 to about 100,000.

8. A toner in accordance with claim 1 which possesses a low fixing temperature of from about 120° C. to about 145° C., and a broad fusing latitude of from about 40° C. to about 120° C.

9. A toner in accordance with claim 1 wherein the polyimide-imine resin is obtained from the reaction of from about 0.30 mole equivalent to about 0.55 mole equivalent of a dianhydride, from about 0.45 mole equivalent to about 0.55 mole equivalent of a diamine, and from about 0.025 mole equivalent to about 0.1 mole equivalent of a dialdehyde.

10. A toner in accordance with claim 9 wherein the dianhydride is selected from the, group consisting of pyromellitic dianhydride, bicyclo[2.2.2]oct-7-ene2,3,5,6-tetracarboxylic dianhydride, 1,2,4,5-cyclohexanetetracarboxylic dianhydride, 1,4,5,8-naphthalenetetracarboxylic dianhydride, 3,4,9, 10-perylenetetracarboxylic dianhydride, 5-(2,5-dioxotetrahydrol)-3-methyl-3-cyclohexene-1,2-dicarboxylic dianhydride, and ethylenediamine tetracetic acid dianhydride in an effective amount of from about 35 mole percent to about 47.5 mole percent of polyimide-imine resin.

11. A toner in accordance with claim 9 wherein the diamine is selected from the group consisting of diaminoethane, diaminopropane, 2,3-diaminopropane, diaminobutane, diaminopentane, diamino-2-methylpentane (DYTEK A TM) diaminohexane, diamino-trimethylhexane, diaminoheptane, diaminoctane, diaminononane, diaminodecane, diaminododecane, diamino-terminated diethyleneoxide, diaminoterminated triethyleneoxide, and a polyoxyalkylene of the formula

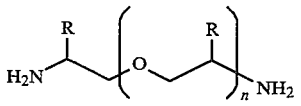

wherein R represents a hydrogen or alkyl group; and n represents the number of monomer segments and is a number of from about 1 to about 10; and which diamine is selected in an effective amount of from about 45 mole percent to about 55 mole percent of polyimide imine resin.

12. A toner in accordance with claim 9 wherein the dialdehyde monomer is selected from the group consisting of terephthaldicarboxaldehyde, isophthylaldehyde, phthalic dicarboxaldehyde, 1,3-glutaric dialdlehyde, 1,4-adipic dialdehyde, pimelic dialdehyde, suberic dialdehyde, azealic dialdehyde, sebacic, dialdehyde nonaic dialdehyde, decanoic dialdehyde, dodecanoic dialdehyde, tridecanoic dialdehyde, and is selected in an effective amount of from about 2.5 mole percent to about 15 mole percent of polyimide-imine resin.

13. A toner composition in accordance with claim 1 with a glass transition temperature thereof of from about 50° C. to about 65° C.

14. A toner composition in accordance with claim 1 with a relative humidity sensitivity of from about 1.01 to about 2.3.

15. A toner composition in accordance with claim 1 further including a charge enhancing additive incorporated into the toner, or present on the surface of the toner.

16. A toner composition in accordance with claim 1 further containing a wax component with a weight average molecular weight of from about 1,000 to about 10,000.

17. A toner composition in accordance with claim 1 further containing as external additives metal salts of a fatty acid, colloidal silicas, or mixtures thereof.

18. A toner composition, in accordance with claim 1 wherein the pigment is carbon black, magnetites, or mixtures thereof, cyan, magenta, yellow, red, blue, green, brown, or mixtures thereof.

19. A toner in accordance with claim 1 wherein X is

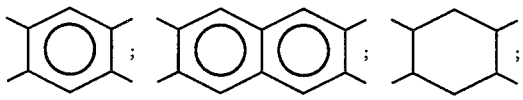

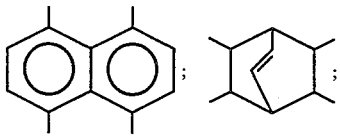

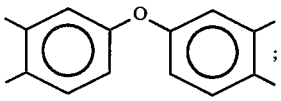

-continued

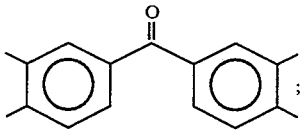

; or

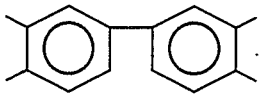

.

20. A developer composition comprised of a toner comprised of pigment and a polyimide-imine resin of the formula

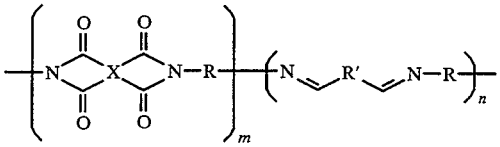

wherein m, and n represent the number of monomer segments, and wherein m is a number of from about 100 to about 10,000 and n is a number of from about 10 to about 1,000; X is independently selected from the group consisting of a tetravalent aromatic, polycaronialic or cycloaliphatic group with from about 6 to about 20 carbon atoms and a cycloaliphatic group; R is independently selected from the group consisting of alkylene, oxyalkylene and polyoxyalkylene; and R′ is independently selected from the group consisting of alkylene and arylene; and carrier particles.

21. A developer composition in accordance with claim 20 wherein the carrier particles are comprised of ferrites, steel, or an iron powder with an optional coating, or mixture of coatings.

22. A method of imaging which comprises formulating an electrostatic latent image on a negatively charged photoreceptor, and affecting development thereof with a toner comprised of pigment and a polyimide-imine resin of the formula

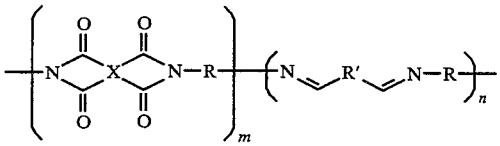

wherein m, and n represent the number of monomer segments, and wherein m is a number of from about 100 to about 10,000 and n is a number of from about 10 to about 1,000; X is independently selected from the group consisting of a tetravalent aromatic, polyaromatic or cycloaliphatic group with from about 6 to about 20 carbon atoms and a cycloaliphatic group; R is independently selected from the group consisting of alkylene, oxyalkylene and polyoxyalkylene; and R′ is independently selected from the group consisting of alkylene and arylene, and thereafter transferring the developed image to a suitable substrate.

* * * * *